US005333393A

United States Patent [19]

Hill et al.

[11] Patent Number: 5,333,393

[45] Date of Patent: Aug. 2, 1994

[54] SHOE RETAINING APPARATUS AND METHOD

[76] Inventors: Tyrone Hill, 2213 W. Spaulding, Dixmoor, Ill. 60426; Larry D. Franklin, 19427 Oak Ave., Country Club Hills, Ill. 60478

[21] Appl. No.: 75,661

[22] Filed: Jun. 11, 1993

[51] Int. Cl.[5] ..... F26B 7/00

[52] U.S. Cl. ..... 34/440; 34/104; 34/600

[58] Field of Search ..... 34/133 D, 133 E, 133 G, 34/133 H, 104, 105, 239, 21; 248/205.1, 309.1, 316.1

[56] References Cited

U.S. PATENT DOCUMENTS

| | | | |
|---|---|---|---|
| 4,109,397 | 8/1978 | Daily | 34/133 E |
| 4,617,743 | 10/1986 | Barnard | 34/133 E |
| 4,677,760 | 7/1987 | St. Louis | 34/90 |
| 4,702,016 | 10/1987 | Grigsby | 34/104 |
| 4,813,641 | 3/1989 | Wilson | 34/104 |
| 4,908,959 | 3/1990 | Kretchman et al. | 34/133 E |
| 5,220,734 | 6/1993 | Carver | 34/133 E |

*Primary Examiner*—Denise Gromada

[57] ABSTRACT

An apparatus (12) for retaining a shoe (18) within a clothes dryer (10) having a rotatable chamber (16), the apparatus (12) having a shoe tree (28) with a toe support member (38) and a heel support member (36) for maintaining the inner shape of the shoe (18), a bracket (26) interconnecting the shoe tree (28) and a clamp (20) which is releasably secured to the rotatable chamber (16) of the dryer (10).

20 Claims, 3 Drawing Sheets

SHOE RETAINING APPARATUS AND METHOD

BACKGROUND OF THE INVENTION

1. Field of the Invention

This invention relates generally to the field of shoe drying apparatus and more particularly to such an apparatus secured within the chamber of a clothes dryer.

2. Description of the related art including information disclosed under 37 CFR §1.97–1.99

The drying of wet shoes is frequently done by placing the shoes in a conventional clothes dryer. Circulated air dries the shoes as they tumble in the dryer. Since the heavy damp shoes are not held in a stationary position within the dryer, they are thrown as the dryer drum rotates. Thus, placing unsecured shoes within a rotating dryer drum often causes damage to the shoes and the dryer. Additionally, heat from the metallic dryer drum surface can damage some shoe materials, such as rubber, as these materials contact the metallic surface. Moreover, the throwing of heavy wet shoes within the dryer is very noisy. Furthermore, at times the thrown shoes in the rotating chamber will knock the dryer door open thereby turning off the dryer and preventing the shoe from being dried.

Devices for holding objects, such as shoes, stationary within an interior surface of a drier are known. Such devices can be seen in U.S. Pat. No. 4,109,397 to Daily, issued Aug. 29, 1978, U.S. Pat. No. 4,813,641 to Wilson issued Mar. 21, 1989 and U.S. Pat. No. 4,677,760 to St. Louis issued Jul. 7, 1987.

In U.S. Pat. No. 4,109,397 of Daily, a rack with an open work basket portion is mounted to the drum of a conventional clothes dryer. Articles placed within the rack are dried as the drum rotates. The rack prevents damage to the articles from tumbling against the drum as the dryer rotates. In U.S. Pat. No. 4,813,641 of Wilson, a shoe holder made of a flexible material is attached to a suction cup that is connected to the inside wall of a clothes dryer. In these known drying devices the articles are supported from their outer portions and not from their interior portions. Disadvantageously, during drying a shoe article it shrinks and loses its natural shape in these known devices. Frequently, the shape of a shoe becomes distorted and damaged during drying and the drying process is slowed down due to the shoe being held from its exterior regions. Moreover, the supporting members adjacent the exterior region of the shoe cover various parts of the shoe, thereby blocking air flow and preventing adequate drying to those blocked regions of the shoe.

In U.S. Pat. No. 4,677,760 of St. Louis issued Jul. 7, 1987 a rack is mounted to the door of a clothes dryer. A boot or shoe is placed on the rack for drying. Disadvantageously, since the rack is mounted to the door of the drier and not to the rotatable drum, the shoe does not circulate as the drum rotates thereby providing an inefficient means for shoe drying. Additionally, due to the configuration of the rack the natural shape of the shoe is lost and becomes distorted when the shoe eventually dries.

SUMMARY OF THE INVENTION

It is therefore the principle object of the present invention to provide an apparatus and method for retaining and drying a damp shoe in a conventional clothes dryer which overcomes the above disadvantages of known shoe drying devices by holding an interior portion of the shoe to retain the shape of the shoe as the shoe is placed in a conventional dryer.

This object is achieved in part by providing an apparatus for retaining a shoe within a clothes dryer having a rotatable chamber having means for holding the shoe in which at least a portion of the holding means is in contact with the inside portion of the shoe and means connected to the holding means for releasably securing the holding means to the rotatable chamber.

The object of the invention is also achieved by providing an apparatus for retaining a shoe within a clothes dryer having a rotatable chamber, the apparatus having means for retaining the shape of the shoe and means connected to the retaining means for releasably securing the retaining means to the dryer.

The object is also achieved by providing a method for releasably securing a shoe within a clothes dryer having a rotatable chamber, comprising the step of inserting at least a portion of a shoe holder in an inside portion of the shoe and releasably securing the shoe holder to the rotatable chamber of the clothes dryer.

BRIEF DESCRIPTION OF THE DRAWINGS

The foregoing objects and advantageous features of the invention will be explained in greater detail and other will be made apparent from the detailed description of the preferred embodiments of the present invention which are given with reference to several figures of the drawing, in which.

DESCRIPTION OF THE PREFERRED EMBODIMENT

Figure 1:
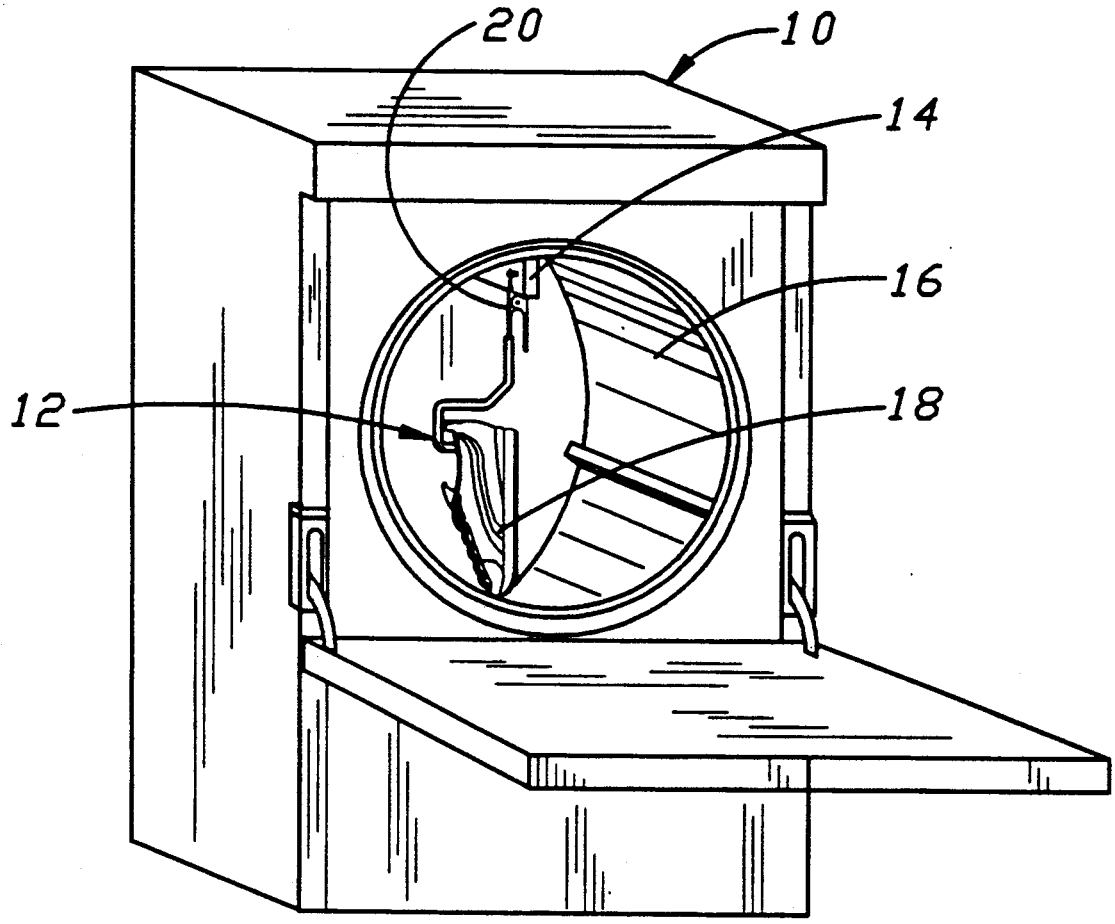
FIG. 1 is a perspective view of a conventional clothes dryer with the shoe retaining apparatus of the present invention suspending a shoe within the dryer.

Referring to FIG. 1, conventional clothes dryer 10 is shown with shoe retaining apparatus 12 of the present invention releasably mounted to fin 14 of rotatable chamber 16 of the dryer. The apparatus 12 retains shoe 18 within clothes dryer 10 by means of resilient securing clamp 20 mounted to fin 14 on rotatable chamber 16. As dryer drum chamber 16 rotates shoe 18 moves through the air and is dried by air circulating about and inside of shoe 18, however since the shoe is suspended by apparatus 12 at a distance away from rotating chamber 16, the problems associated with throwing the shoe about the rotating chamber are avoided. Spacing shoe 18 from the walls of rotating chamber 16 further promotes proper air circulation through the shoe thereby increasing the drying time of the shoe.

Figure 2:
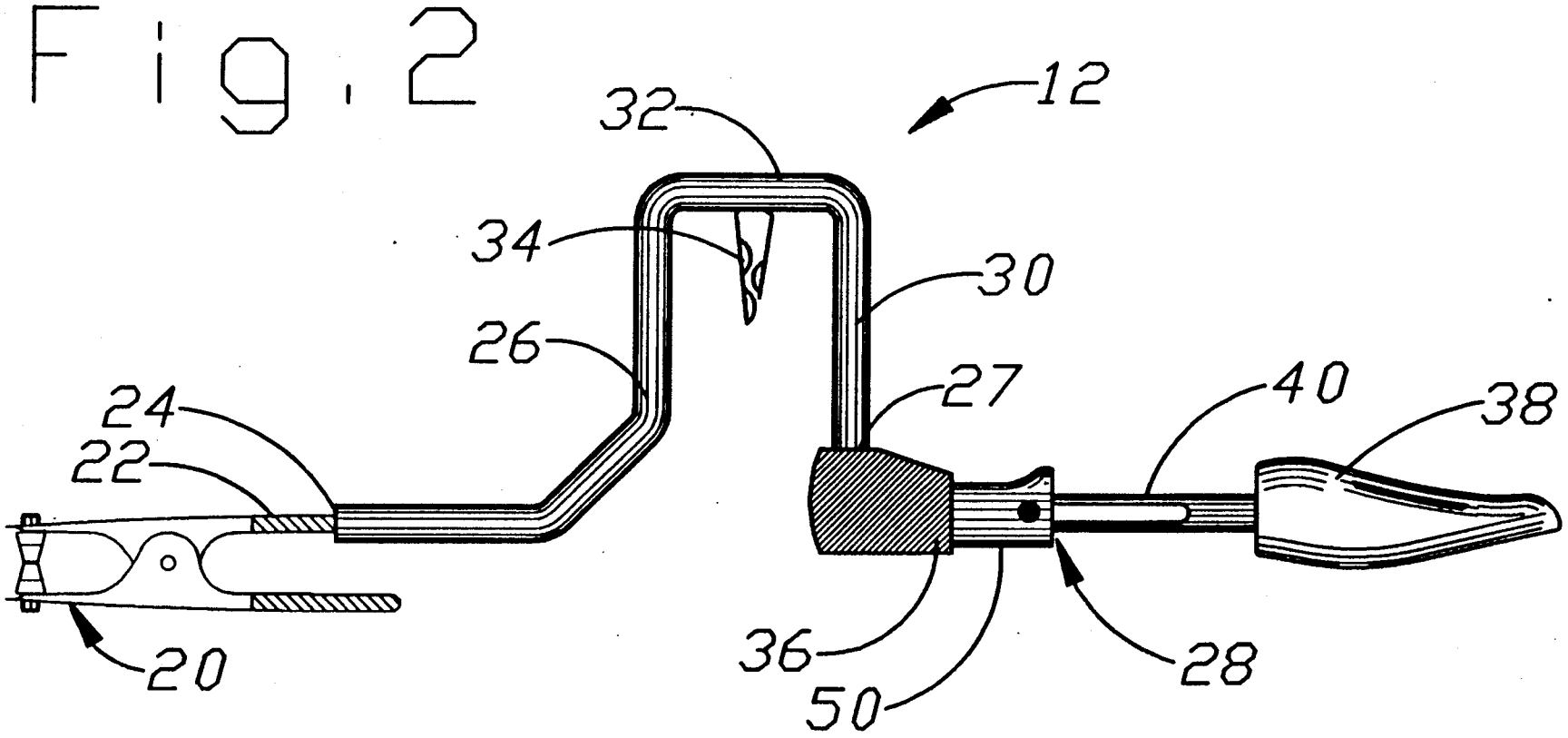
FIG. 2 is a side view of one embodiment of the shoe retaining apparatus of the present invention.

Referring to FIG. 2, one embodiment of shoe retaining apparatus 12 is shown with handle end 22 of releasable securing clamp 20 attached to end 24 of bracket member 26. Another end 27 of bracket 26 is preferably connected to shoe tree member 28 which holds and maintains the shape of the shoe 18 as it rotates within the clothes dryer 10, FIG. 1. Bracket 26, in FIG. 2, is preferably made of sturdy PVC type plastic pipe, however other commonly known materials including but not limited to steel, aluminum, wood, etc. having sufficient strength to support the damp shoe 18 and shoe tree 28 may also be employed. Bracket 26 may encompass many configurations. Preferably, bracket 26 has lateral portion 30 connected to and extending laterally from a heel member 36 of the shoe tree 28 and cross portion 32 transverse to lateral portion 30. Secured to cross portion 32 of bracket 26 is resilient clip 34 for holding an inside portion and outside portion proximate to the heel region of the shoe. Clip 34 increases the securement of the shoe 18 to apparatus 12 as the shoe is supported by shoe tree 28. Alternatively, a slide clip such as those seen in U.S. Pat. Nos. 3,698,607 and 3,767,092 may be employed to provide the additional securement of the shoe 18, as well as many other commonly known clips. Shoe tree member 28 connected to bracket 26 is a foot-shaped form which conforms to the natural shape of the inner portion of the shoe 18, FIG. 1. As shown in FIG. 2, the shoe tree 28 includes heel support member 36 and toe support member 38 interconnected by elongate shaft 40 disposed between them. Shaft 40 could take on other forms such as being a resilient spring member which would interconnect heel support member 36 and toe support member 38 and bias them. Shoe tree member 28 in FIG. 2 is inserted into the inner portion of the shoe 18 to preserve the shape of the shoe as it circulates within the dryer 10 as seen in FIG. 1.

Figure 3:
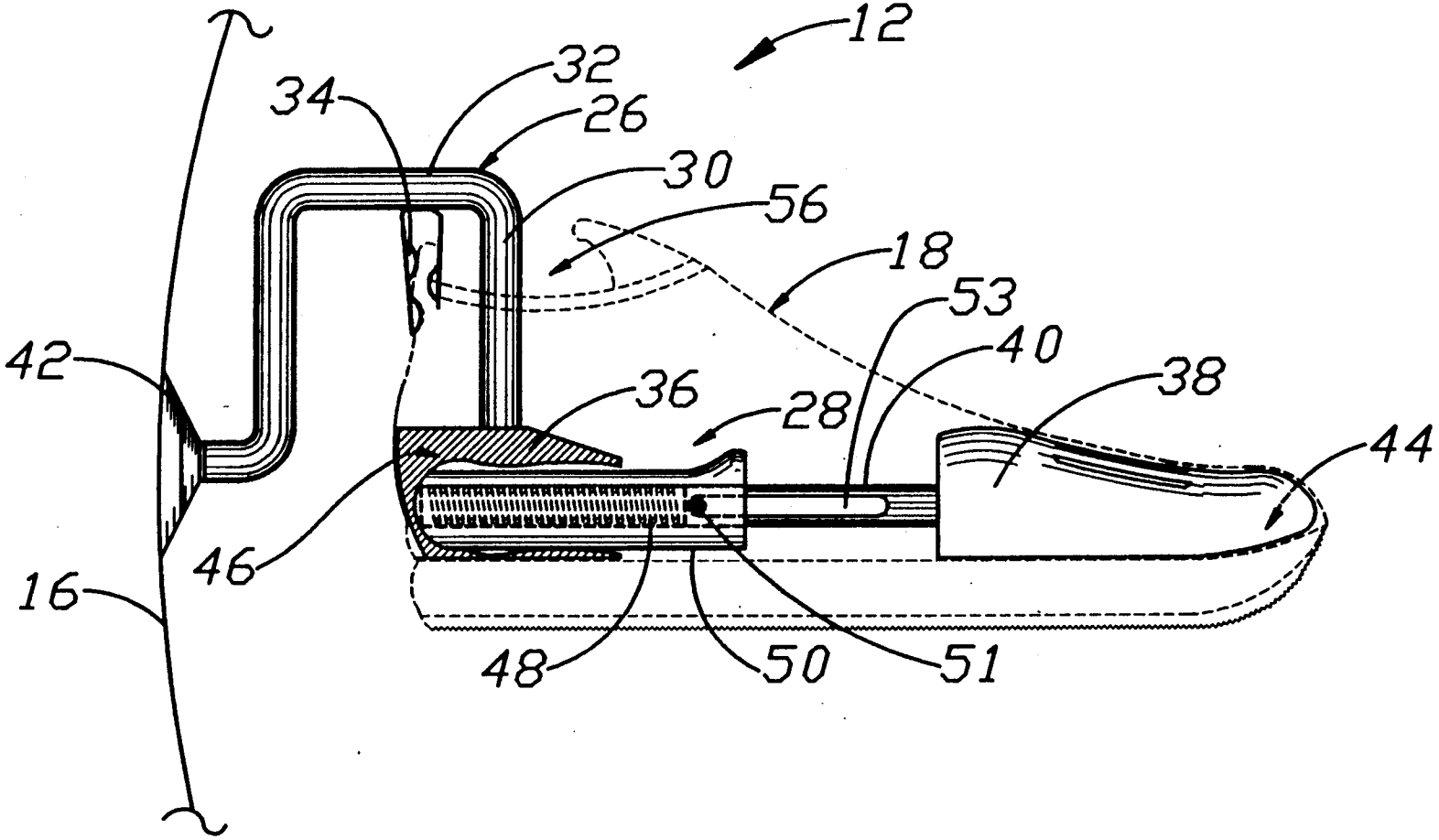
FIG. 3 is a side view of an alternate embodiment of the shoe retaining apparatus of the present invention illustrating the apparatus holding a shoe and secured to the rotatable chamber.

Referring to FIG. 3, another embodiment of shoe retaining apparatus 12 is shown holding the inner portion of shoe 18. In this alternate embodiment of the present invention suction cup 42 is used as a releasable securement means to a side wall of rotatable chamber 16. Bracket 26 interconnects the shoe tree 28 to suction cup 42. Shoe tree 28 holds and supports the inside portions of the shoe. Toe support member 38 supports interior toe region 44 of shoe 18 and heel support member 36 of shoe tree 28 supports interior heel region 46 of the shoe. Additionally, heel member 36 and toe member 38 conform to the natural shape of interior heel region 46 and interior toe region 44 of the shoe respectively. As seen in FIG. 3, spring 48 is connected to and housed within intermediate member 50 of shoe holder 28. Spring 48 is contained within intermediate member 50 and is attached to elongate shaft 40 disposed between toe member 38 and heel member 36. In the preferred embodiment a portion of intermediate member 50 is housed and secured within heel support member 36. Spring 48 resiliently biases elongate shaft 40 to enable the distance between heel member 36 and toe member 38 to be easily adjusted thereby permitting shoe tree 38 to be placed in shoes of varying sizes. Spring 48 seen disposed in intermediate member 50 is held within member 50 by stop member 51 which is connected to intermediate member 50. Spring 48 can be compressed bringing members 36 and 38 closer together with stop member 51 moving within slot 53 of shaft 40. The resilient interconnection between heel support member 36 and toe support member 38 by means of spring 48 further enables shoe tree 28 to retain the shape of shoe 18 as it rotates within dryer 10. Spring 48 creates a lateral force throughout shoe tree 28. These forces are transferred to inner toe region 44 and inner heel region 46 of shoe 18, thereby preventing the shoe from curling up against itself as it is being dried. Additional securement means of shoe 18 is provided by clip 34 attached to bracket 26. Resilient clip 34 is preferably mounted to bracket 26 in a position such that it pinches and holds an inside portion and outside portion of shoe 18 proximate to shoe opening 56. In general it is desirable to orient opening 56 of shoe 18 in the direction to receive the air as rotatable chamber 16 rotates. This will increase the drying time and efficiency.

While the advantages of the invention are preferably obtained with shoe retaining apparatus 12 having shoe holder 28 described above with reference to FIGS. 1-3, the method of the invention can be practiced with other shoe retaining apparatus which releasably secure a shoe within a clothes dryer. In any event, the steps of the preferred method of practicing the invention comprise the steps of (1) inserting at least a portion of the shoe holder in an inside portion of the shoe, and (2) releasably securing the shoe holder to the rotatable chamber of the clothes dryer.

Referring again to FIG. 3, this method is preferably performed with shoe retaining apparatus 12 by placing toe member 38 of shoe holder 28 in inner toe region 44 of shoe 18 and placing heel member 36 at inner heel region 46 of the shoe. Shoe holder 28 of the present invention preferably is shoe tree 28 with elongate shaft member 40 interconnecting heel member 36 and toe member 38. Shoe holder 28 is releasably secured to rotatable drum chamber 16 by clamping resilient clamp 20, connected with the shoe holder, to rotatably chamber 16, as seen in FIG. 1, of clothes dryer 10. Alternatively, the step of releasably securing the shoe holder is accomplished by connecting suction cup 42, as seen in FIG. 3, that is connected to shoe holder 28 by bracket 26, to rotatable chamber wall 16 of the dryer. Clip 34 connected to bracket 26 disposed between clamp 20, as seen in FIG. 2, and the shoe tree or shoe holder 28 is secured to an inside portion and outside portion of shoe 18.

While a detailed description of the preferred embodiment of the invention has been given, it should be appreciated that many variations can be made thereto without departing from the scope of the invention as set forth in the appended claims.

We claim:

1. An apparatus for retaining a shoe within a clothes dryer having a rotatable chamber, comprising:

means for holding the shoe in which at least a portion of the holding means is in contact with the inside portion of the shoe and in which the holding means includes a toe support member for supporting an interior toe region of the shoe and a heel support member for supporting an interior heel region of the shoe; and means connected to the holding means for releasably securing the holding means to the rotatable chamber.

2. The shoe retaining apparatus of claim 1 in which the releasably securing means includes a clamp connected to the holding means.

3. The shoe retaining apparatus of claim 1 in which the releasably securing means includes a suction cup.

4. The shoe retaining apparatus of claim 1 including a clip secured to a bracket connected to the holding means and the releasably securing means.

5. The shoe retaining apparatus of claim 1 in which the holding means includes means for resiliently interconnecting the toe support member and the heel support member.

6. The shoe retaining apparatus of claim 1 in which the holding means includes means for maintaining the inner shape of the shoe.

7. The shoe retaining apparatus of claim 6 in which the maintaining means includes a shoe tree.

8. The shoe retaining apparatus of claim 7 in which the shoe tree includes an elongate shaft disposed between a heel member and a toe member of the shoe tree and in which the elongate shaft is spring biased to resiliently adjust the distance between the heel member and toe member.

9. An apparatus for retaining a shoe within a clothes dryer having a rotatable chamber, comprising:

means for retaining the shape of the shoe including means insertable into the shoe for supporting a heel portion of the shoe and a toe portion of the shoe; and means connected to the retaining means for releasably securing the retaining means to the rotatable chamber of the dryer.

10. The shoe retaining apparatus of claim 9 in which the supporting means includes a heel member for supporting the heel portion of the shoe, a toe member for supporting the toe portion of the shoe, and means for interconnecting the heel member and toe member.

11. The shoe retaining apparatus of claim 10 in which the interconnecting means includes a spring member to resiliently bias the toe member relative to the heel member.

12. The shoe retaining apparatus of claim 9 in which the supporting means includes a shoe tree connected to the releasably securing means by a bracket disposed and interconnected between the releasably securing means and the shoe tree.

13. The shoe retaining means of claim 12 including a clip secured to the bracket for holding an inside portion of the shoe and an outside portion of the shoe.

14. The shoe retaining means of claim 9 in which the releasably securing means includes a suction cup.

15. The shoe retaining means of claim 13 in which the releasably securing means includes a clamp releasably securable to the rotatable chamber of the dryer.

16. A method for releasably securing a shoe within a clothes dryer having a rotatable chamber, comprising the steps of:

inserting at least a portion of a shoe holder in an inside portion of the shoe;

placing a toe member in an inner toe region of the shoe;

placing a heel member at an inner heel region of the shoe; and releasably securing the shoe holder to the rotatable chamber of the clothes dryer.

17. The method of claim 16 in which the shoe holder includes a shoe tree having an elongate shaft member interconnecting the heel member and the toe member.

18. The method of claim 16 in which the step of releasably securing the shoe holder includes the step of clamping a clamp connected with the shoe holder to the rotatable chamber of the clothes dryer.

19. The method of claim 18 including the step of securing a clip to the inside portion of the shoe and an outside portion of the shoe in which the clip is connected to a bracket disposed between the clamp and the shoe holder.

20. The method of claim 16 in which the step of releasably securing the shoe holder includes the step of connecting a suction cup connected to the shoe holder to the rotatable chamber of the clothes dryer.

* * * * *